United States Patent [19]

Schisler

[11] Patent Number: 4,915,180

[45] Date of Patent: Apr. 10, 1990

[54] POST DRIVER

[76] Inventor: Ralph T. Schisler, 2548 Marston Rd., New Windsor, Md. 21776

[21] Appl. No.: 267,928

[22] Filed: Nov. 7, 1988

[51] Int. Cl.[4] ..... E21C 11/02

[52] U.S. Cl. ..... 173/22; 173/43; 173/44; 173/139

[58] Field of Search ..... 173/22, 27, 28, 43, 173/44, 139

[56] References Cited

U.S. PATENT DOCUMENTS

| | | | |
|---|---|---|---|
| 2,852,992 | 9/1958 | Simmonds | 173/22 X |
| 2,940,267 | 6/1960 | Shaver | 173/46 |
| 3,172,483 | 3/1965 | Spitzer | 173/28 X |
| 3,447,613 | 6/1969 | Lisenby | 173/43 X |
| 3,507,338 | 4/1970 | McWaters et al. | 173/28 |
| 3,563,319 | 2/1971 | Nixon | 173/22 |
| 3,602,316 | 8/1971 | McNicholas | 173/43 X |
| 3,700,047 | 10/1972 | Gartner | 173/28 |
| 4,050,526 | 9/1977 | Deike | 173/28 X |
| 4,068,728 | 1/1978 | Subrick | 173/27 |
| 4,124,081 | 11/1978 | Deike | 173/139 X |
| 4,303,130 | 12/1981 | Bonca | 173/28 X |

*Primary Examiner*—Frank T. Yost
*Assistant Examiner*—Scott A. Smith
*Attorney, Agent, or Firm*—Eugene F. Osborne, Sr.

[57] ABSTRACT

A post driver has a combination of hydraulically operable orthogonal and angular mechanical carriages giving five degrees of motion of the driving hammer for the setting of posts in various soils and terrain slopes. Adjustment of the carriages allows accurate location of posts in a fence line that is offset from the line of travel of the supporting tractor. The structure of the apparatus provides distributed weight to both sides of the tractor to assure its stability and safety for operations over variable terrain slopes. A post sleeve and holding bar contain the posts for hands-off driving and also provide means for overcoming post misalignment due to variable density and stony soils. A damping device is added to the impact hammer mechanisms.

15 Claims, 3 Drawing Sheets

POST DRIVER

BACKGROUND OF THE INVENTION

1. Field of the Invention

This invention relates to mobile machinery for driving posts into the ground for the construction of fences, safety barriers, guard railing, retaining walls, or like constructions. It is intended as a substitute for hole digging, fill, and tamping apparatus.

2. Related Prior Art

For many decades the customary approach to the building of fences involved the digging of holes of appropriate depth, the placement of the post therein, and filling of the surrounding hole with removed soil and tamping to stabilize the emplaced post, all of which required much manual labor. Then came angle and "Tee" metal posts, or small cross section, that could be driven in place by hammer or manual driving tools. But posts, having large cross sections are still desired for many decorative and utilitarian applications, including fences about lawns and pastures for horses, and for safety barriers, etc. A long standing need has existed for efficient labor saving apparatus for setting posts upright in all types of soils and upon terrain having variable slopes and contours.

An early mobile post driver is disclosed in U.S. Pat. No. 2,940,267, issued to Shaver in 1960. Shaver teaches a percussion driver, that is, a hydraulic system to lift a mechanical mass of a driving block and H beam above the post so that upon release of hydraulic pressure gravity will provide a driving force to set the post in the soil without the need for digging or filling post holes. The device of Shaver is intended for mounting on the longitudinal axis of a tractor of the row crop type generally used in agricultural operations. Mechanical adjustments were provided for vertical driving of the post, however the location of the post at a desired place required accurate maneuvering of the tractor.

In a less demanding allied area, the U.S. Pat. No. 3,563,319, issued to Nixon in 1971 teaches apparatus for the setting of small pins or stakes in concrete forms used in highway construction. Since the concrete form must follow the slope of the graded roadbed the only need for verticality adjustment is in the lateral direction to the roadway. The setting of pins is accomplished by hydraulic force rather than by gravity action on hammer mass. Verticality of the applied force is adjusted by a hydraulic lateral tilting of the chassis of the platform which is supported by three wheels, two of which are arranged longitudinally and the third being offset laterally from the two.

SUMMARY OF THE INVENTION

This invention provides improvements in apparatus for driving posts in various soils and terrain slopes. The most frequent application is in the construction of fences along a specified line or boundary. Although the invention is not limited in its embodiment, typical posts for fencing range 7–9 feet in length and as large as 8 inches by 10 inches in cross section.

The system of this invention requires a heavy duty tractor of the type having a wide front axle to provide a stable mobile platform for the post driver so that operations may be safely performed on steep terrain slopes. A massive belly mounted frame, attached to the undercarriage of the tractor supports the post driving mechanisms at a variable offset position on the right side, facing forward, of the tractor. The belly mounted frame extends beneath the tractor frame and beyond to the left side for the support of static weights and a sump reservoir supply of hydraulic oils. The mass of the hydraulic oil and weights on the side of the tractor opposite to the driving mechanism is for stabilizing the tractor against roll reactions about its longitudinal axis during the operation of the drive mechanism. Additional weights are mounted at the front of the tractor and each wheel is filled with liquid for weight to suppress vibrations and bounce about the tractor roll and pitch axes.

The belly frame includes a hydraulically operable carriage having a forward-aft travel of sixteen (16) inches and a lateral travel (in-out) perpendicular to the longitudinal axis of the tractor of two (2) feet. Thus each post may be accurately placed in a fence line without extensive tedious maneuvering of the mobile tractor. But in order that posts may be driven vertically on compound slopes of the terrain, the movable carriage has superimposed hydraulic tilting mechanisms in two directions. The driver may be tilted forward or backward 35 degrees about an axis perpendicular to the longitudinal plane of the tractor. The driver may simultaneously tilt in or out 35 degree about an offset axis parallel to the tractor's longitudinal plane. All of the control valves for operation are located at the post driver for the convenience of the attendant.

Therefore it is a principal object of this invention to provide apparatus for driving posts at the expense of minimum manual labor.

Another object of this invention is to provide a mobile platform for post driver that may operate from an offset line of travel to set posts in a prescribed fence or boundary line; or adjacent to otherwise hazardous locations.

Another object of this invention is to provide a flexible and versatile carriage and tilting controls for the post driver to enable accurate location and verticality of each post independent of variable terrain slopes and precise positioning of the mobile tractor platform.

Another object of this invention is to provide an adequate distribution of weight to improve the stability of the tractor platform as posts are driven by impact forces.

Another object of this invention is to provide apparatus and accessory tools for aligning rectangular posts with the desired fence line for proper attachment of fencing boards or rails.

Another object of this invention is to provide apparatus and accessory tools for resisting the misalignment of posts being driven into stony or variable density soils.

Another object of this invention is to use the weight of the operating reservoir of hydraulic fluid for balancing the mass distribution of the system.

Another object of this invention is to provide a mechanical sleeve for holding a post throughout the driving procedure so that the attendant may stand clear of the moving elements and so that vertical alignment of the post may be forced by carriage movement while the driver hammer freely operates.

Another object of this invention is to provide a side mounted post driver supported by a belly frame that may be readily assembled or dismounted from the tractor frame.

Another object of this invention is to locate the complete system center of gravity at a low elevation point near to the geometric center of the platform.

Another object of this invention is to increase the performance capability of the platform by the addition of an auxiliary hydraulic system powered by the tractor engine and cooled by the tractor cooling fan.

Still another object of this invention is to provide means of stowing the post driver mechanisms during transport of the apparatus.

Still another object of this invention is to locate all post driver controls for standing operation by the attendant at a position convenient for insertion of posts to the driver.

Other objects, features, and advantages will become apparent from the description in connection with the accompanying drawings of the preferred embodiment of the invention.

BRIEF DESCRIPTION OF THE DRAWINGS

The invention is described with reference to accompanying drawings, in which.

DESCRIPTION OF THE PREFERRED EMBODIMENT

Figure 1:
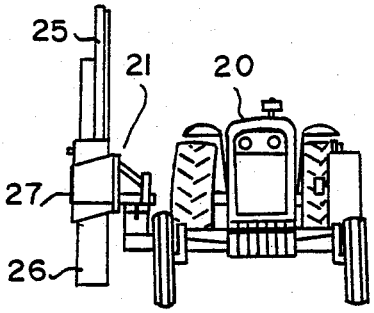
FIG. 1 is an elevation view along the longitudinal axis looking to the rearward from the front of the tractor.
Figure 3:
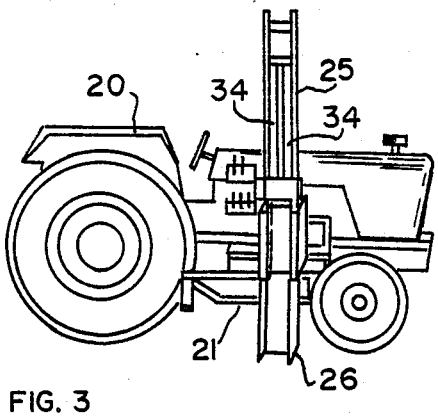
FIG. 3 is an elevation side view showing the post driver portion mounted to the tractor.
Figure 2:
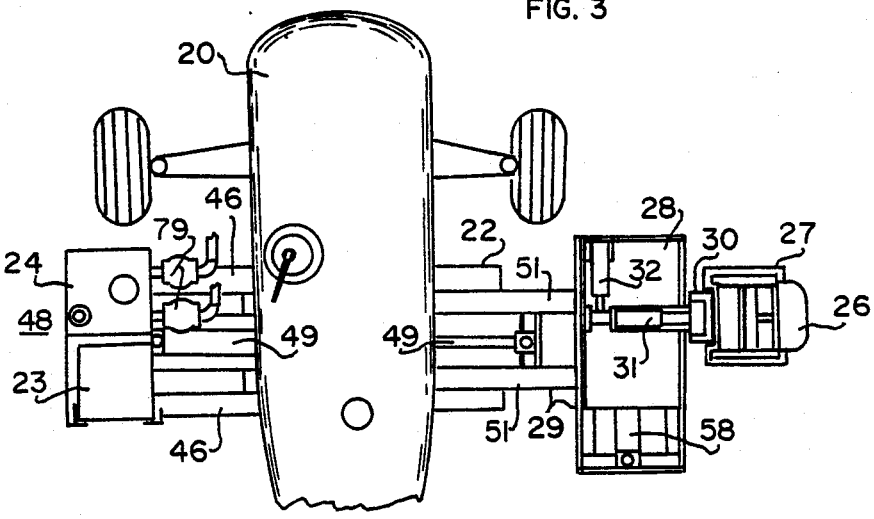
FIG. 2 is a plan view of the system.
Figure 4:
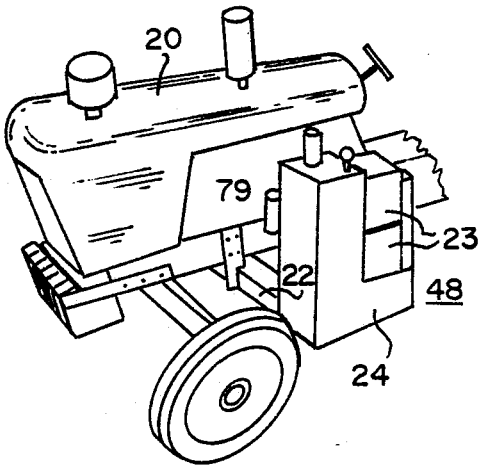
FIG. 4 is an elevation side view showing the static counterweights and hydraulic reservoir portions of the system as mounted to the tractor.
Figure 5:
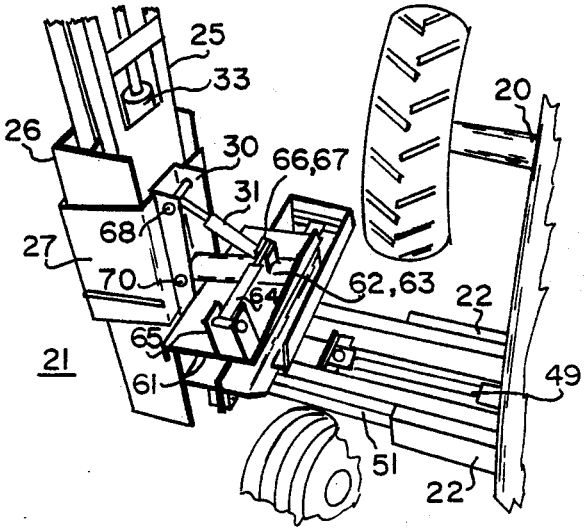
FIG. 5 is a perspective of the hydraulic actuated carriage and tilt mechanisms.
Figure 6:
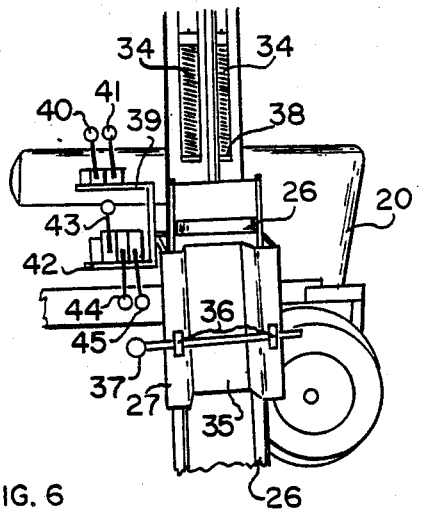
FIG. 6 is a view of the attendant's controls.

Referring to the drawings there is shown a heavy duty tractor 20 of the four wheel wide front axle type. The post driving subsystem 21 is offset mounted to the right side of the tractor 20, FIGS. 1–3, through a belly subframe 22, FIGS. 7–8, that extends to the left side of the tractor 20 to support static counterweights 23 and a reservoir 24 containing a supply of operating fluid for the post driving hydraulic subsystems. The tires of each of the four tractor wheels are filled with a non-freezing liquid for added weight thus the total mass provides a low center of gravity and stability during operation of the mechanisms on terrain of varying slopes.

Figure 17:
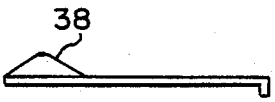
FIG. 17 is a view of a damper for the post driver springs.

The post driving subassembly includes a tower 25, extending upward from the angular carriage 28 through a pivoting channel mount 30 or fixture that is hydraulically operable to achieve vertical erection of the tower on terrain slopes through a lateral tilt cylinder 31 and a parallel tilt cylinder 32. The tilt cylinder 32. The lateral and parallel tilt cylinders, 31 and 32, are double acting and have a range of plus and minus thirty five degrees of angular movement. A vertical lift cylinder 33, one end being attached to the tower 25 raises a drop hammer H-channel 26, above a post being driven, against the restraining force of a pair of return coiled driving springs 34. The vertical lift cylinder 33 is single acting. Upon release of hydraulic pressure in the lift cylinder 33 the combined forces of gravity and of the return driving springs produce rapid downward movement of the drop hammer 26 with impact to drive a post into soils or grounds of varied density or hardness. Interposed between the pivoting mount 30 and the tower 25 is the post sleeve 27 which wraps around the H-channel of the drop hammer 26, with clearance for movement within. The post sleeve 27 provides a recessed rectangular guide cavity 35 into which the post is placed in anticipation of driving it into the soil. The post sleeve 27 is provided with a pair of retaining rings 36, welded to opposite sides of its frontal surfaces so that a holding bar 37 may be passed through each ring to bridge the guide cavity 35 to capture a post placed therein while the drop hammer 26 is operated to drive posts. A pad 38 of rubber or similar material, FIG. 17, is positioned within the tower 25 in contact with the return driving springs 34 for suppressing spring oscillations and failures due to hammer impact.

Attached to the side of the post sleeve 27 facing to the rear of the tractor 20 is the attendant's station for the post driver subsystem 21. A top bracket 39, attached to the sleeve 27, has assembled thereon a first double acting valve 40 for fore-and-aft carriage control and a second double acting valve 41 for in-and-outward carriage control. Attached lower down to the sleeve 27, the low bracket 42 has assembled thereon a single acting valve 43 to control the lift of the drop hammer 26, plus a third double acting valve 44 for control of lateral tilt and a fourth double acting valve 45 for control of parallel tilt.

Figure 7:
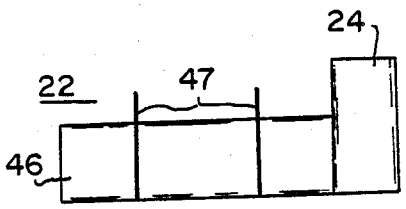
FIG. 7 is a frontal perspective of the belly frame.
Figure 8:
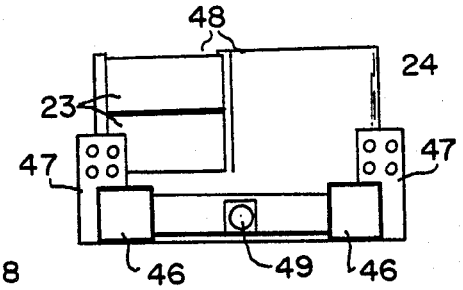
FIG. 8 is a driver side view of the belly frame.

Between the belly subframe 22 and the post driving subsystem 21 is the orthogonal carriage 29 which provides positioning of posts in rectangular coordinates offset from the longitudinal axis of the tractor 20, perpendicular and parallel thereto. The belly subframe, FIGS. 7, 8, provides two parallel five inch rectangular slide tubes 46, five feet in length which are suspended perpendicular to the tractor 20 frame by four mounting plates 47. Opposite the carriage 29, the ends of the slide tubes 46 are terminated and bridged by the counterweight 20 and reservoir 24 subassembly 48. The reference end of the double acting in-out hydraulic cylinder 49, which lies symmetrically between the slide tubes 46, is attached to the counterweight and reservoir subassembly 48. The upper and lower surfaces of each of the parallel slide tubes 46 function as slide ways for movement in and out of the lateral orthogonal subcarriage 50.

Figure 9:
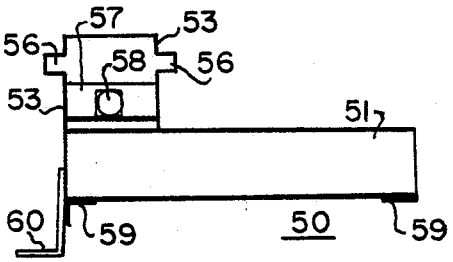
FIG. 9 is a side view of the in-and-out orthogonal carriage.
Figure 10:
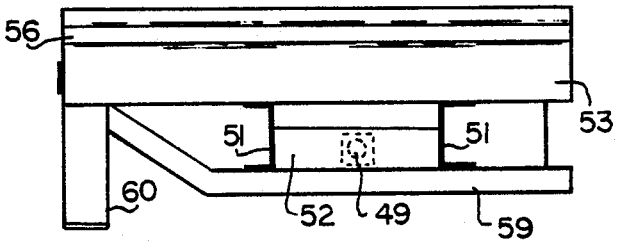
FIG. 10 is an end view of the in-and-out orthogonal carriage.
Figure 11:
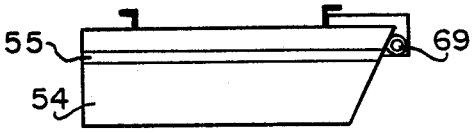
FIG. 11 is a side view of the fore-and-aft slide tube.
Figure 12:
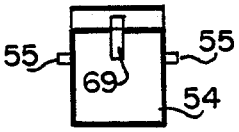
FIG. 12 is an end view of the fore-and-aft slide tube.
Figure 13:
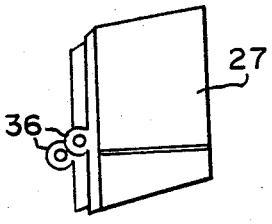
FIG. 13 is a view of the post driver sleeve.
Figure 14:
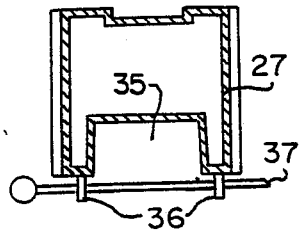
FIG. 14 is a cross section through the driver assembly along lines A—A of FIG. 13.

The in-out subcarriage 50, FIGS. 9, 10 has two parallel slide channels 51, formed from three inch angle stock, that are positioned in the subcarriage 50 for mating with, enclosing, and sliding upon the rectangular slide tubes 46 of the belly subframe 22. The inner surfaces of each top and each bottom flanges of the parallel slide channels 51 provide slide ways for movement upon the enclosed rectangular tubes 46 of the belly subframe 22, FIGS. 8 and 10. A cross member with Clevis bracket 52 receives the yoke of the piston of the in-out hydraulic cylinder 49. The range of the in-out movement provided by the subcarriage 50 and hydraulic actuator 49 is two feet. Reinforcing cross members 52 maintain the integrity of the in-out subcarriage 50. Welded to the outer extreme end of the slide channels 51 and perpendicular thereto, are two parallel fore-and-aft guides 53 that are separated to receive within the guides 53 a single ten inch fore-and-aft rectangular slide tube 54 which has symmetrically welded to each vertical side thereof a half by one inch rectangular slide track 55 extending the length of the slide tube 54, FIGS. 11 and 12. Each of the fore-and-aft guides 53 is provided with a slot 56, or groove, extending the length thereof for receiving and enclosing the respective slide track 55 of the fore-and-aft slide tube 54.

The ends of the two guides 53 facing to the rear of the tractor 20 are bridged and terminated by a heavy reinforced guide cross member with pivot yoke 57 which receives the reference end of a fore-and-aft hydraulic actuator 58 which is centered horizontally and slopes upward diagonally within the slide tube 54 for connection to its upper pivot 69. The limit of fore-and-aft movement produced by the actuator 58 is sixteen (16) inches. The fore-and-aft guides 53 are further reinforced by an assembly of underside cross and longitudinal angle members 59. A footstep 60 is welded to the outer guide in near proximity to its rearward end.

Superimposed upon the upper surface of the fore-and-aft slide tube 54 is the angular carriage 28. An intermediate mounting fixture or base plate 61, spaced apart but bolted to the fore-and-aft slide tube 54, has a bent downward flange on the side adjacent to the post driving subsystem 21 and a bent upward flange on the side toward the tractor 20 for reinforcement of the plate 61. Centered and welded to the base plate 61 are an axle tube and mount blocks 62 for the transverse pivot axle 63 which allows a fore-and-aft or parallel angular tilt of the post driving subsystem 21 relative to the tractor's longitudinal axis. The reference or cylinder end of the double acting hydraulic pivot actuator 64 is tied to the base plate 61 through a vertical clevis bracket 65 that is welded at the forward edge of the base plate 61. The yoke of the piston end of the actuator 64 operates through a crank arm 66 for tilting the post driving subsystem 21 about the pivot axle 63. The rotatable pivot axle 63 has, at its inner end nearest the tractor 20, brackets welded to it forming a lateral yoke 66 in which the cylinder end of the double acting lateral tilting hydraulic actuator 67 is pinned. The lateral tilting actuator extends upward in a plane perpendicular and to the tractor 20 to connect in an upper pivot joint 68 of the drive subassembly pivoting mounting fixture or channel 30. The outward end of the pivot axle 63 connects in a lower pivot joint 70 of the mounting channel 30.

In the complete assembly the mounting channel 30 abuts the rearward side of the post sleeve 27 which encloses the tower 25 and the drop hammer elements of the post driving subsystem 21. The channel 30, the sleeve 27 and the tower are bolted together and are thus, as a combined mechanism, responsive to hydraulic actuator control to four degrees of mechanical motion relative to the tractor 20, i.e. fore-and-aft and in-and-out orthogonal movement plus parallel and lateral angular tilting movement.

Figure 15:
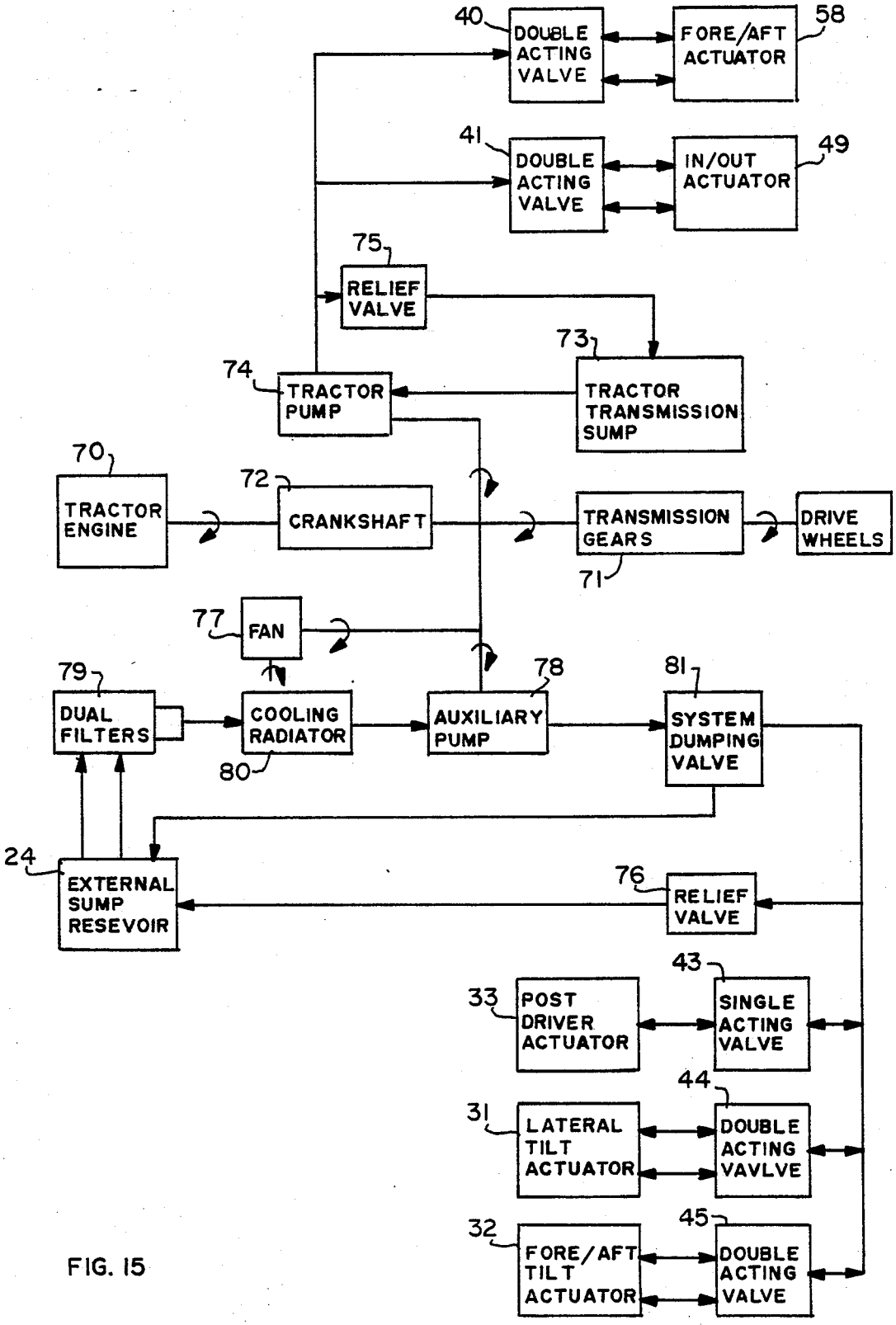
FIG. 15 is a block diagram of the hydraulic subsystems.

A schematic or flow diagram for the hydraulics of the post driver, FIG. 15, shows a dual hydraulic subsystem utilizing a low volume hydraulic pump of the tractor 20 and an added high volume auxiliary external source. The engine 70 of the tractor 20 is the prime source of power for motion and for hydraulic pressure and volume. The engine 70 is coupled to the power train gear box 71 having internal transmission gearing 71, a sump reservoir 73 for lubricating and hydraulic fluid, the tractor hydraulic pump 74. The hydraulic output of the tractor pump 74 is transmitted to a relief or bypass valve 75 which is in turn connected to each of the fore-and-aft 40 and in-and-out 41 control valves which operate the double acting fore-and-aft 58 and in-and-out 49 actuators of the orthogonal carriage 29. The bypass valve 75 returns the excess hydraulic fluid to the sump 73 of the power train gear box 71.

The high volume auxiliary hydraulic source operates from the separate reservoir 24 mounted externally on the belly subframe 22. The front crankshaft of the tractor engine 70 is . coupled to the cooling fan 77 and to an added auxiliary high capacity hydraulic pump 78. As the engine crankshaft rotates the auxiliary pump 78 draws hydraulic fluid from the reservoir 24 through dual filters 79 and an added hydraulic fluid cooling radiator 80 and supplies fluid under pressure via hoses through a a system dumping valve 81 to the parallel combination of a relief valve 76 and the control valves 43, 44, and 45 for the drop hammer vertical lift actuator 33, the lateral tilt actuator 31, and the parallel tilt actuator 32 respectively. The lift actuator 33 is single acting, the tilt actuators, 31, and 32, are double acting. The excess fluid under pressure is returned via hoses by the external relief valve 76 and control valves 43–45 to the reservoir 24. The auxiliary source supplies the high volume needs of the post drop hammer lift actuator 33 and the needs of the angular carriage 28. The attendant may switch the system valve 81 to a dumping mode when the post driver is not to be used while the tractor is operating.

Figure 16:
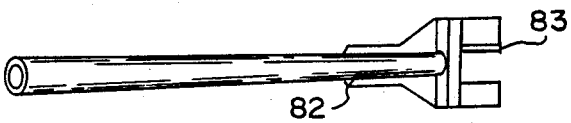
FIG. 16 is a plan view of a post aligning tool.

In post setting operations the tractor 20 is advanced by the attendant along but offset from the fence line to the approximate location for the next post. The orthogonal and angular carriages 29 and 28 are operated as necessary to accurately locate and vertically align the tower 25 and drop hammer 26 for the particular post location in tractor position, and terrain slope. As the post is being driven into the ground should the presence of stones, etc. deflect the post from the vertical, operation of the angular and orthogonal carriages 28, 29 may be used by the attendant to restore by force applied through the post sleeve 27, the verticality and/or location of the post. In some instances a rectangular post being driven against stones or non-uniform soils may be rotated about the vertical axis relative to a fence line. The tool 82, shown in FIG. 16 is used by the attendant to realign the post in azimuth angle as driving is continued. The tool 82 is adaptable by inserts 83 for various sizes of posts.

This invention may be embodied in other specific forms without deviating from its concepts and essential characteristics. The preferred embodiment disclosed above is therefore to be considered in all respects as illustrative and not limiting, the scope of the invention being indicated by the appended claims.

Having described the invention, I claim:

1. An implement for use with a tractor and like mobile vehicles in the driving of posts in diverse soils and terrain, comprising:

(a) a supporting frame with means for mounting beneath the belly of said tractor normal to the longitudinal axis of said tractor at a location between the rear and forward wheels thereof;

(b) a mechanical subassembly of operable carriages upon a first end of said supporting frame for four degrees of movement of a mounting channel of said implement, said subassembly of carriages comprising two orthogonal and two angular subcarriages;

(c) an impact post driving hammer subassembly having a single degree of movement for attachment upon said mounting channel of said subassembly of operable carriages, the combination of said driving hammer and operable carriages having five degrees of mechanical movement for the driving of said posts from a fixed position of said tractor;

(d) a subassembly of balancing counterweights affixed at the opposite second end of said supporting frame for establishing a low centralized center of gravity for yielding stability and for reducing roll reactions in the operation of the combined apparatus of said implement and tractor when deployed upon sloping terrain:

(e) means responsive to an attendant's control for adjusting verticality, azimuth, and location of said posts with said driving hammer during operation of said implement:

(f) means of supplying implement power from the engine of said tractor for operation of said implement;

(g) a group of controls at a ground station adjacent to said hammer subassembly, operable by a single attendant who may at said ground station insert said posts in said hammer subassembly and operate said controls for selective application of said implement power to activate and execute said five degrees of mechanical movement for the driving of said posts; and (h) means for damping oscillatory vibrations of post driving tension springs of the driving hammer subassembly following hammer impact with posts during driving operations.

2. An implement for the driving of posts as recited in claim 1, wherein said combined carriage and post driving subassemblies comprise:

(a) a first orthogonal carriage for a first movement inward-and-outward perpendicular to said longitudinal axis of said tractor for locating said post driving hammer upon a post positioned within a fence line adjacent to a side of said tractor;

(b) a second orthogonal carriage for a second movement forward-and-backward parallel to said longitudinal axis of said tractor for locating said post driving hammer upon a post positioned along a fence line parallel to said tractor;

(c) a third carriage for a first angular movement in fore-and-aft angular tilting of said post driving hammer clockwise-and-counterclockwise in a plane parallel to said longitudinal axis of said tractor for the vertical driving of said posts in sloping terrain;

(d) a fourth carriage for a second angular movement in lateral angular tilting of said post driving hammer clockwise-and-counterclockwise in a plane perpendicular to said longitudinal axis of said tractor for said vertical driving of posts in sloping terrain; and (e) an apparatus for a fifth movement in lifting said post driving hammer upward for release for the downward impact driving of said posts into said soils of said fence line.

3. An implement for the driving of posts as recited in claim 2, wherein said first carriage for inward-and-outward lateral motion of said post driving hammer comprises:

(a) two similar elongated slide channels positioned back-to-back and parallel to each other, said elongated channels having complementary slide ways on the inner surfaces of each top and each bottom edged flange and separation distances there between for slideable contact with parallel slideways of said supporting frame;

(b) a multiplicity of channel-to-channel structural cross members affixed to said two elongated channels for maintaining said parallel separation distance;

(c) two parallel elongated fore-and-aft guides affixed upon the outer end of said slide channels and perpendicular thereto with a separation between said guides for receiving a rectangular slide tube of said second carriage therein, said fore-and-aft guides having facing slots the length thereof which comprise slide grooves for said second carriage;

(d) a reinforced guide cross member affixed to and bridging the aft ends of said parallel fore-and-aft guides, said guide cross member having an integral pivot yoke symmetrically placed for attachment of the cylinder of a linear double acting actuator for movement of said second carriage; and (e) said linear actuator for effecting said inward-and-outward lateral motion of said post driving hammer.

4. An implement for the driving of posts, as recited in claim 2, wherein said second carriage for forward-and-backward orthogonal motion of said post driving hammer comprises:

(a) an elongated tube of rectangular cross section, said tube comprising:

a reinforcing member welded at the center of an upper surface of the tube top section;

a pair of rectangular slide tracks of complimentary size to fit within companion slide grooves of mating fore-and-aft guides of said first carriage, welded one to the outer surface of each side section of said tube extending the length thereof parallel to each other; and a pivot arm welded at its forward end to the under surface of the top section opposite said reinforcing member for the attachment of the piston of a linear actuator for effecting said forward-and-backward motion; and (b) said linear actuator for effecting said forward-and backward motion of said post driving hammer.

5. An implement for the driving of posts, as recited in claim 2, which comprises:

(a) apparatus for said first carriage for effecting said inward-and-outward orthogonal movements through a range of at least two feet;

(b) apparatus for said second carriage for effecting said forward-and-backward movements through a range of at least sixteen inches;

(c) apparatus for said third carriage for effecting said fore-and-aft angular tilting movement of said post driving hammer for the driving of posts in a range of at least plus and minus thirty five degrees relative to a pitch axis of said tractor; and (d) apparatus for said fourth carriage for effecting said lateral angular tilting movement of said post driving hammer for the driving of posts in a range of at least plus and minus thirty five degrees relative to said longitudinal axis of said tractor.

6. An implement for the driving of posts, as recited in claim 1 wherein said means of supplying implement power from said tractor engine, comprises:

(a) a hydraulic subsystem of said tractor, operable from said engine of said tractor for effecting, subject to control of said attendant, said movements of said orthogonal subcarriages; and (b) an auxiliary hydraulic subsystem of high volumetric capacity, operable from the external forward end of the crankshaft of said engine for effecting, subject to control of said attendant, said movements of said angular subcarriages plus said movement of said post driving hammer.

7. An implement for the driving of posts, as recited in claim 3, wherein said means of supplying implement power from said tractor engine, further comprises:

(a) said hydraulic subsystem of said tractor operable from said engine of said tractor, comprising:

an internal reservoir of hydraulic fluid;

a hydraulic pump for supply of pressurized fluid to an external relief valve;

a first double acting valve in said attendant's control subassembly for controlling inward-and-outward orthogonal movement of said driving hammer perpendicular to said tractor longitudinal axis;

a second double acting valve in said attendant's control subassembly for controlling forward-and-backward orthogonal movement of said driving hammer parallel to said tractor longitudinal axis.

a first double acting hydraulic actuator operable between said supporting frame and said subassembly of carriages, responsive to fluid pressure and flow applied by said first valve, subject to said attendant's control, for effecting said inward-and-outward orthogonal movement.

a second double acting hydraulic actuator operable between an in-and-out carriage and a fore-and-aft carriage, responsive to fluid pressure and flow applied by said second valve, subject to said attendant's control for effecting said forward-and-backward orthogonal movement; and means for containing the flow of hydraulic fluid between said internal reservoir, said external relief valve, said first and second valves, said first and second actuators, and an external return port to said internal reservoir of said tractor hydraulic subsystem; and (b) said auxiliary hydraulic subsystem operable from said forward end of the crankshaft of said engine, comprising:

a second reservoir for an auxiliary supply of hydraulic fluid;

dual particle filters for the output ports of said second reservoir;

a cooling radiator for said auxiliary hydraulic fluid responsive to the cooling action of the tractor engine fan;

a high volumetric capacity pump operable, by mechanical coupling to said engine crankshaft, on fluid received from said cooling radiator;

a subsystem valve for the output of said pump, said valve having a selectable dumping mode subject to said attendant's control for quiescent post driver operating conditions;

a third double acting valve in said attendant's control subassembly for controlling said fore-and-aft angular tilting of said post driving hammer, receiving fluid from said subsystem valve;

a fourth double acting valve in said attendant's control subassembly for controlling said lateral angular tilting of said post driving hammer, receiving fluid from said subsystem valve;

a single acting valve in said attendant's control subassembly for controlling said lifting of said post driving hammer in anticipation of driving said posts in said soils, receiving fluid from said subsystem valve;

a third double acting hydraulic actuator, operable between a base plate attached to said fore-and-aft carriage and a pivot axle, responsive to fluid pressure and flow applied by said third valve, subject to said attendant's control for effecting said fore-and-aft angular tilting of said driving hammer;

a fourth double acting hydraulic actuator, operable between said pivot axle and a pivoting joint in a mounting channel for a tower containing said post driving hammer, responsive to fluid pressure and flow applied by said fourth valve, subject to said attendant's control for effecting said lateral angular tilting of said driving hammer;

a single acting hydraulic actuator, operable between said tower and said driving hammer, responsive to fluid pressure and flow applied by said single acting valve subject to said attendant's control, for effecting said lifting of said post driving hammer in anticipation of release to drive said posts by downward impact; and means for containing the flow of said hydraulic fluid within said auxiliary subsystem with return of spent fluids to said second reservoir.

8. An implement for the driving of posts, as recited in claim 1, wherein said subassembly of counterweights at the second end of said supporting frame comprises:

(a) a reservoir for containing fluid for a auxiliary hydraulic subsystem;

(b) a quantity of hydraulic fluid in said reservoir for operation of said auxiliary subsystem;

(c) dual filters for said auxiliary hydraulic subsystem;

(d) a compartmental structure for placement therein of static objects having high densities; and (e) at least one cast metallic object of size for placement in said compartmental structure.

9. An implement for the driving of posts, as recited in claim 1, wherein said means for adjusting verticality, azimuth, and location of said posts during operation of said driving hammer comprises:

(a) a post sleeve, interposed between a pivoting mount of said subassembly of operable carriages and a tower of said drive hammer subassembly, said post sleeve being a reinforced wraparound structure enclosing said tower and an H-channel of said driving hammer subassembly, said sleeve having a recessed rectangular cavity extending upward in an exposed face of said sleeve into which said posts are placed for driving, said sleeve further comprising first and second retaining rings symmetrically attached on opposite frontal surfaces of said exposed face with the central axes of said rings directed across said cavity;

(b) a holding bar for insertion through each of said first and second retaining rings to bridge across said recessed rectangular cavity after a post has been placed therein, said holding bar for captivating said post during driving operations;

(c) means for restoring a vertical driving angle of said posts after being offset by variable soil conditions and intercepted obstacles by operation of said orthogonal and angular subcarriages; and (d) means for adjusting the azimuth angle of said posts during driving operations for alignment of a side of rectangular posts parallel to a fence line.

10. An implement for the driving of posts, as recited in claim 1, wherein said means for damping oscillator vibrations of said driving springs comprises:

(a) at least one damper comprising an elongated steel plate having a rubber pad bonded thereto, said steel plate for attachment by welding within said driving hammer subassembly in a manner that makes rubbing contact between said rubber pad and said post driving tension springs of said driving hammer subassembly.

11. An implement for the driving of posts, as recited in claim 1, wherein said group of controls, operable by said attendant for the driving of posts, comprises:

(a) a first double acting hydraulic valve for effecting the location of said driving hammer subassembly in a plane parallel to the longitudinal axis of said tractor;

(b) a second double acting hydraulic valve for effecting the location of said driving hammer subassembly in a plane perpendicular to said longitudinal axis of said tractor;

(c) a third double acting hydraulic valve for effecting the angular tilt of said driving hammer subassembly in said plane parallel to said longitudinal axis of said tractor;

(d) a fourth double acting hydraulic valve for effecting the angular tilt of said driving hammer subassembly in said plane perpendicular to said longitudinal axis of said tractor;

(e) a single acting hydraulic valve for operation of said driving hammer subassembly in the driving of said posts; and (f) a means of assembling said group of controls in an operating station for said attendant that is isolated from the impact of said driving hammer subassembly during the driving of said posts into said soils.

12. An implement for the driving of posts as recited in claim 1, wherein said supporting frame further comprises:

(a) four mounting plates suitably spaced for attachment to an under structure of said tractor, two of said plates for attachment to each side of said tractor under structure;

(b) two similar rectangular elongated tubes for attachment to said mounting plates to extend beyond said tractor under structure in a direction perpendicular to the longitudinal axis of said tractor, said tubes attached parallel to each other and separated by a distance allowing clearance for placement there between of a linear double acting actuator for said carriage subassembly, said tubes further having on upper and lower surfaces parallel slide ways for said orthogonal subcarriages; and (c) said counterweight subassembly for bridging across and attachment to said parallel rectangular tubes at the second end of said supporting frame, said counterweight subassembly having a reinforced member with an integral pivotable yoke placed thereon for symmetrical attachment of the cylinder of said linear actuator between said parallel slide ways.

13. An implement for the driving of posts, as recited in claim 1, wherein said angular subcarriages comprises:

(a) a base mounting plate for attachment upon the fore-and-aft moving element of said orthogonal subcarriages, said mounting plate comprising:
- an inside edge, nearest said tractor, bent upward into a flange for reinforcement;
- an outside edge, away from said tractor, bent downward into a flange for reinforcement;
- a transverse axle tube with mount blocks welded to said mounting plate perpendicular to the longitudinal axis of said tractor; and
- a U-shaped clevis bracket, attached extending upward from the forward end of said mounting plate for attachment thereto of a linear double acting actuator for fore-and-aft tilting of said post driving hammer;

(b) a fore-and-aft pivoting axle for assembly in said transverse axle tube and mount blocks of said mounting plate, said pivoting axle comprising:
- an integral yoke at its inner end nearest said tractor for attachment of the cylinder of a lateral tilting actuator of the double acting linear type; and
- a pivoting joint in its outer end away from said tractor that is transverse to the axis of said axle; and (c) an upstanding mounting channel for attachment thereto said impact post driving hammer subassembly, said mounting channel comprising:
- a lower pivoting joint for connection to said transverse pivoting joint of said fore-and-aft axle;
- an upper pivoting joint for connection thereto of the piston end of said lateral tilting actuator;
- a first pin for securing said lower pivoting joint; and
- a second pin for securing said upper pivoting joint.

(d) said double acting linear actuator for effecting lateral tilting of said post driving hammer; and (e) said double acting linear actuator for effecting fore-and-aft tilting of said post driving hammer.

14. Apparatus for the driving of posts, into terrain of variable slopes and soil characteristics, from an offset line of travel for the construction of fences and similar barriers along prescribed lines upon said terrain, which comprises:

(a) a tractor, or like vehicle, comprising:
- an engine for power generation;
- a power train for mobility of said tractor;
- a wide rear axle for said tractor;
- a wide front axle for said tractor;
- at least four distributed wheels for said axles for stability of said tractor when maneuvering over said sloping terrain; and
- a means of supplying take-off power from said engine;

(b) a structure for attachment to said tractor at a location between said front and rear axles comprising means for:
- the assembly and support upon a first lateral side of said tractor of a maneuverable offset post driving subsystem that is responsive to control by an attending operator of said apparatus;
- the assembly and support upon a second lateral side of said tractor, opposite to said post driving subsystem, of a subassembly of system components comprising: counterweight for maintaining weight balance and the stability of the platform of said apparatus during its maneuvering and post driving operations upon said terrain;

(c) a mechanical subsystem of actuators and movable carriages, operable by said take-off power, that are responsive to selective control of said attending operator, comprising:

a first subassembly for the reciprocative location of a post driver in a two foot range of positions extending laterally beyond the line of travel of said tractor wheels, which comprises:

* an in-and-out carriage, operable perpendicular to said line of tractor travel;
* a first double acting actuator for linear movement of said in-and-out carriage; and
* a first device, responsive to said attending operator, for control of said first actuator and in-and-out carriage;

a second subassembly for the reciprocative location of said post driver in a sixteen inch range of positions extending fore-and-aft along a line parallel to said line of tractor travel, which comprises:

* a fore-and-aft carriage, operable parallel to said line of tractor travel;
* a second double acting actuator for linear movement of said fore-and-aft carriage; and
* a second device, responsive to said attending operator, for control of said second actuator and fore-and-aft carriage;

a third subassembly for the reciprocative lateral tilting of said post driver in a seventy degree range of angles about the line of travel of said fore-and-aft carriage as referred to the direction of the yaw-axis of said tractor, which comprises:

* a lateral tilting carriage;
* a third double acting actuator for angular rotation of said lateral tilting carriage; and
* a third device, responsive to said attending operator, for control of said third actuator and said lateral tilting carriage; and a fourth subassembly for the reciprocative fore-and-aft tilting of said post driver in a seventy degree range of angles about the line of travel of said in-and-out carriage as referred to the direction of said yaw axis of said tractor, which comprises:

* a fore-and-aft tilting carriage;
* a fourth double acting actuator for angular rotation of said fore-and-aft tilting carriage; and
* a fourth device, responsive to said attending operator, for control of said fourth actuator and said fore-and-aft tilting carriage;

(d) means for assembling said post driver to said mechanical subsystem of actuators and movable carriages; and (e) means for mechanical confinement of a post within said maneuverable post driving subsystem during post driving operations, responsive to isolated control by said attending operator.

15. A mechanical device for the adaption of a tractor to the driving of posts, in soils of terrain that slope away from the horizontal plane, from an adjustable offset line of travel of said tractor away from and parallel to a prescribed fence line for said posts, which comprises:

(a) a means of extracting power from the engine of said tractor for the operation of said device;

(b) a structural framework for attachment to said tractor;

(c) a first mechanical subassembly affixed to said structural framework comprising:

a first orthogonal carriage for effecting lateral offset positioning, responsive to control by an attending operator, of an intermediate equipment mounting fixture; and a second orthogonal carriage for effecting fore-and-aft positioning, responsive to control by said attending operator, of said intermediate equipment mounting fixture; and (d) a second mechanical subassembly affixed to said intermediate equipment mounting fixture, comprising:

a first angular carriage for effecting lateral tilting, responsive to control by said attending operator, of a post driver mounting fixture; and a second angular carriage for effecting fore-and-aft tilting, responsive to control by said attending operator, of said post driver mounting fixture.

* * * * *